US005746236A

United States Patent [19]

Tilsley et al.

[11] Patent Number: 5,746,236

[45] Date of Patent: May 5, 1998

[54] KNEE CRUTCH

[76] Inventors: Derek Tilsley; Ruth Tilsley, both of 905 Berkeley St., Santa Monica, Calif. 90403

[21] Appl. No.: 713,435

[22] Filed: Sep. 13, 1996

[51] Int. Cl.[6] ..... A45B 3/00

[52] U.S. Cl. ..... 135/66; 135/72; 135/76

[58] Field of Search ..... 135/65, 66, 68, 135/69, 72, 75, 76, 67

[56] References Cited

U.S. PATENT DOCUMENTS

| | | | |
|---|---|---|---|
| 875,482 | 12/1907 | Wyatt . | |
| 2,378,486 | 6/1945 | Jones | 135/68 |
| 2,678,054 | 5/1954 | Bostelman | 135/68 |
| 2,788,370 | 1/1957 | Chamblee . | |
| 3,074,420 | 1/1963 | Gottman . | |
| 3,272,210 | 9/1966 | Boruvka | 135/72 X |
| 3,596,668 | 8/1971 | Tosto | 135/67 |
| 3,633,967 | 1/1972 | Timmins . | |
| 3,986,502 | 10/1976 | Gilson . | |
| 3,999,565 | 12/1976 | Delacour et al. . | |
| 4,141,375 | 2/1979 | Tykwinski . | |
| 4,291,715 | 9/1981 | Monte | 135/68 |
| 4,867,188 | 9/1989 | Reid | 135/67 |
| 5,086,798 | 2/1992 | Motts | 135/67 |
| 5,291,909 | 3/1994 | Skorman et al. | 135/67 |
| 5,318,068 | 6/1994 | Haugen | 135/66 |
| 5,402,587 | 4/1995 | Buschbacher . | |

*Primary Examiner*—Lanna Mai

*Attorney, Agent, or Firm*—Fulbright & Jaworski, L.L.P.

[57] ABSTRACT

A knee crutch for supporting a patient, comprising a knee receptacle, one or more legs, an upright and a handle, allowing the patient to walk by grasping the handle and moving the knee crutch and injured knee forward, and to stand with hands free, by resting the abdomen against the handle.

22 Claims, 3 Drawing Sheets

KNEE CRUTCH

BACKGROUND OF THE INVENTION

1. Field of the Invention

This invention relates to devices for supporting a patient who either lacks a lower leg or suffers from a injury or disability related to the lower leg. Specifically, this invention relates to a portable knee crutch that will receive and support a patient's knee to allow the patient to both walk, and to stand in a stationary position.

2. Description of the Prior Art

Prior devices consist primarily of crutches, which require a substantial period of time to master. Furthermore crutches place the weight against the armpits, hands and lower arms, causing discomfort in many patients, requiring great physical strength, and causing muscle strain. Additionally, crutches require a patient with an ankle injury to continually lift the injured ankle to keep it off the ground, and generally require considerable muscular strength. Furthermore, crutches are typically so large they are difficult to transport and stow away when not in use. Other prior art devices lack stability, and also require a substantial period of time to master. Examples include U.S. Pat. Nos. 875,482; 2,778,370; 3,074,420; 3,633,967; 3,986,502; 3,999,565; 4,141,375; and 5,402,587. What is needed is a crutch that a patient can easily and quickly learn to use, that is comfortable to use, and when used by one with an injured ankle, keeps the ankle above the ground without effort by the patient, and provides natural weight support through the upper leg.

SUMMARY OF THE INVENTION

In a first aspect, the present invention provides a knee crutch comprising a knee support, at least three base portions, at least one upright portion, at least one handle, wherein the base portion, upright portion and handle portion are sized and oriented so the knee rests in the knee portion and the handle portion rests longitudinally substantially across the abdomen when the patient is in a standing position, allowing the patient to both stand and walk with the knee supported.

In another aspect, the present invention provides a method for supporting a knee of a patient, comprising the steps of placing a knee receptacle atop a base portion, placing a handle atop an upright portion, and mounting the upright portion to the knee receptacle, placing the patient's knee against a knee support, and the patient's abdomen against the handle, lifting the handle and moving the knee, knee receptacle, base portion and upright portion, to walk, and urging the patient's abdomen against the handle to stand upright.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE PREFERRED EMBODIMENT(S)

Figure 1:
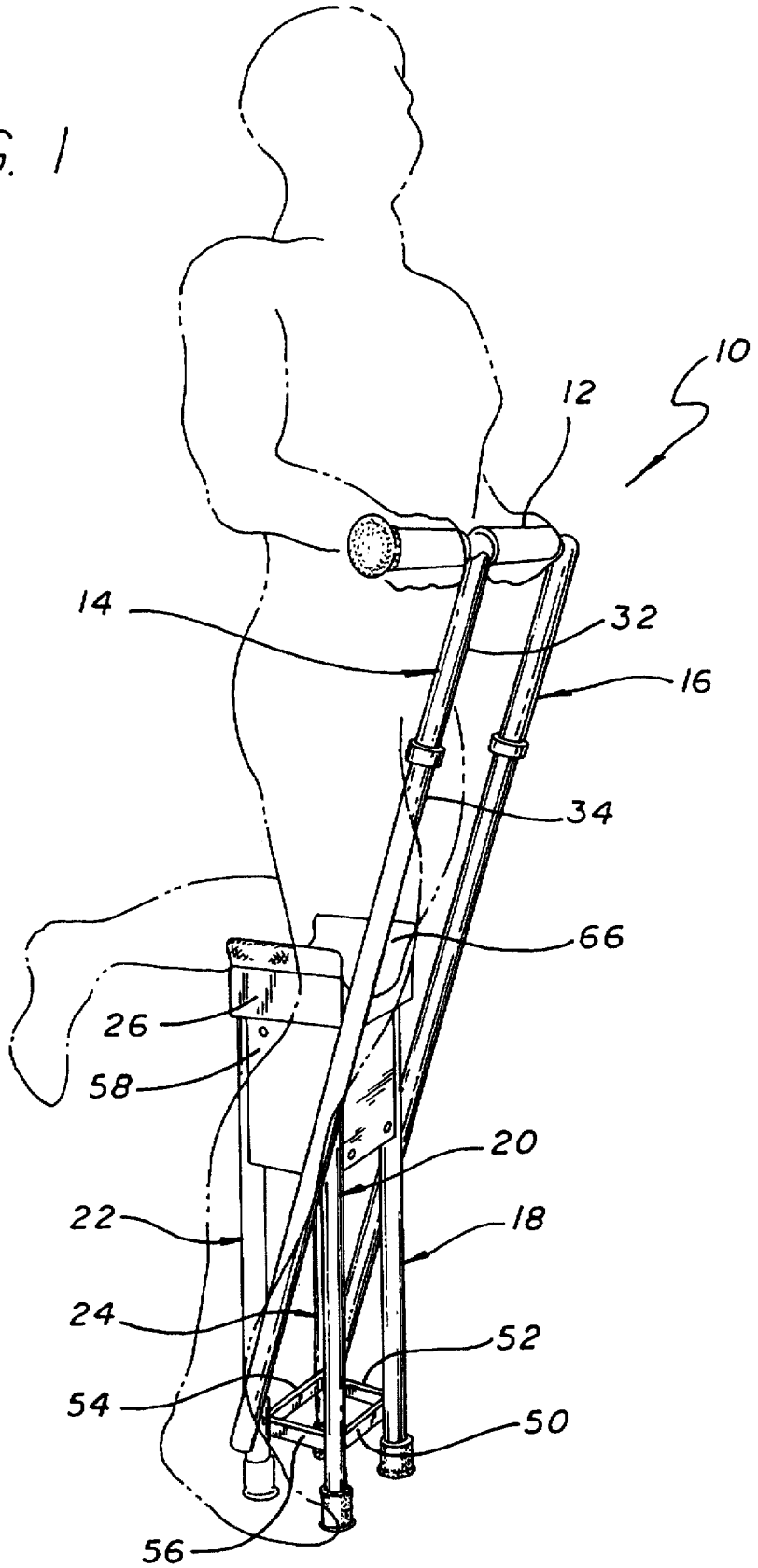
FIG. 1 is an isometric view of the knee crutch of the present invention, with the handle 12 positioned for use with a left leg injury, being used by a patient.

Referring to FIG. 1, a knee crutch 10 has a handle 12, for grasping by one or both hands of a user and adapted for resting against the users abdomen. The handle 12 can be seen more clearly in FIG. 3, where it is shown in an orientation for a patient with a left leg injury, and also shown in relief orientated for a patient with a right leg injury. The handle 12 is mounted to one or more upright portions, such as upright portion 14 and upright portion 16. The handle 12 can be mounted to the upright portions 14 and 16 in any number of ways, such as bolts, clamps or screws, such as screw 28 passing though handle aperture 70 (shown in relief) and screw 29 passing through handle aperture 68 (shown in relief). Upright portion 14 and upright portion 16 have threaded apertures (not shown) for receiving screw 28 and screw 29. The handle 12 should be long enough to fit across the patient's abdomen. In a preferred embodiment, the handle is approximately one foot long.

Figure 5:
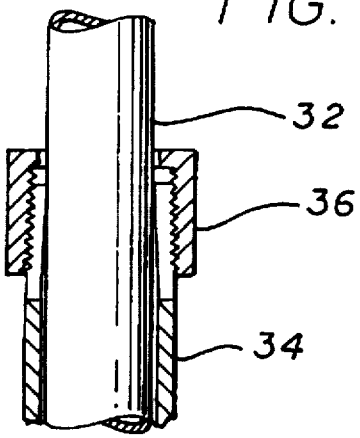
FIG. 5 is a cut away view of a portion of one of the uprights 14 of the present invention, showing an internal clamp.

Upright portion 14 and upright portion 16 are substantially identical, so only upright portion 14 need be described in detail. Viewing FIG. 1 along side of FIG. 5, the upright portion 14 has two sections, an upper upright section 32 and a lower upright section 34. Upper upright section 32 and lower upright section 34 are coupled in telescoping relationship, with the upper upright section 32 slidably mounted into the lower upright section 34. A locking device, such as a cam, pin or in a preferred embodiment, internal clamp 36, is provided to lock the two sections of the upright portion 14, and to allow the user to adjust the height of the handle 12 as needed. To provide a knee crutch 10 that will accommodate users of different heights, the upright portion 14 is capable of telescoping between 15 and 21 inches in length (measured from the handle 12 to the knee support 26). Additional embodiments may be produced for patients of unusual size (tall persons, short persons, children, etc.) by providing an upright portion 14 with a longer or shorter telescoping range.

The knee crutch 10 also includes a knee support 26 for supporting and receiving the knee of the user. The knee support 26 is coupled to and above one or more legs, such as leg 18, leg 20, leg 22, and leg 24, for supporting the knee crutch 10 against a floor (not shown). The lower upright section 34 of the upright portion 14 can be secured to the rest of the knee crutch 10 in any number of ways, such as rigidly mounting the lower upright section 34 to the knee support 26 or, in a preferred embodiment, to one or more legs such as leg 20 and leg 22. If such an embodiment is chosen, the lower upright section 34 of upright portion 14 is secured by bolts, welding or other means, to a leg, such as leg 20 at a point adjacent to knee support 26, and to leg 22 at a point distant from knee support 26. Upright portion 16 will be attached to legs 18 and 22 in a similar fashion.

Figure 4:
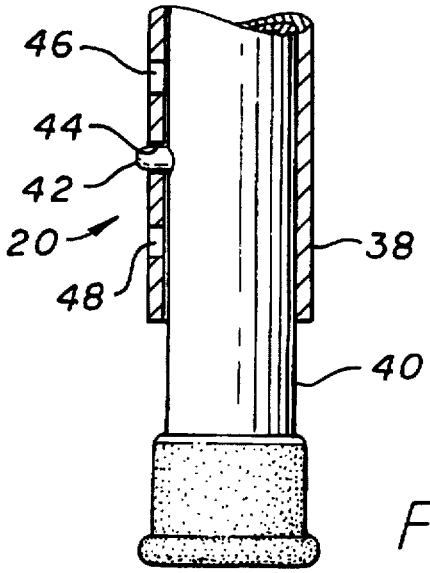
FIG. 4 is a cut away view of the base of one of the legs 20 of the present invention.

The legs are substantially identical, so only leg 20 need be discussed. Referring to FIG. 4, leg 20 includes two portions, a knee portion 38 and a foundation portion 40. The knee portion 38 and foundation portion 40 are coupled in telescoping relationship, with the foundation portion 40 slidably mounted into the knee portion 38, allowing the user to adjust the height of the knee support 26. The foundation portion 40 and the knee portion 38 can be locked relative to each other in any number of ways, such as cams, internal clamps, or in a preferred embodiment, a spring loaded locking pin 42. The knee portion 38 describes a number of apertures, such as aperture 44, aperture 46 and aperture 48, adapted to receive spring loaded locking pin 42. To provide a knee crutch 10 that will accommodate users of different heights, the legs, such as leg 20, are capable of telescoping between 15 and 23 inches in length. Additional embodiments may be produced for patients of unusual size (tall persons, short persons, children, etc.) by providing legs, such as leg 20, with a longer or shorter telescoping range.

Figure 2:
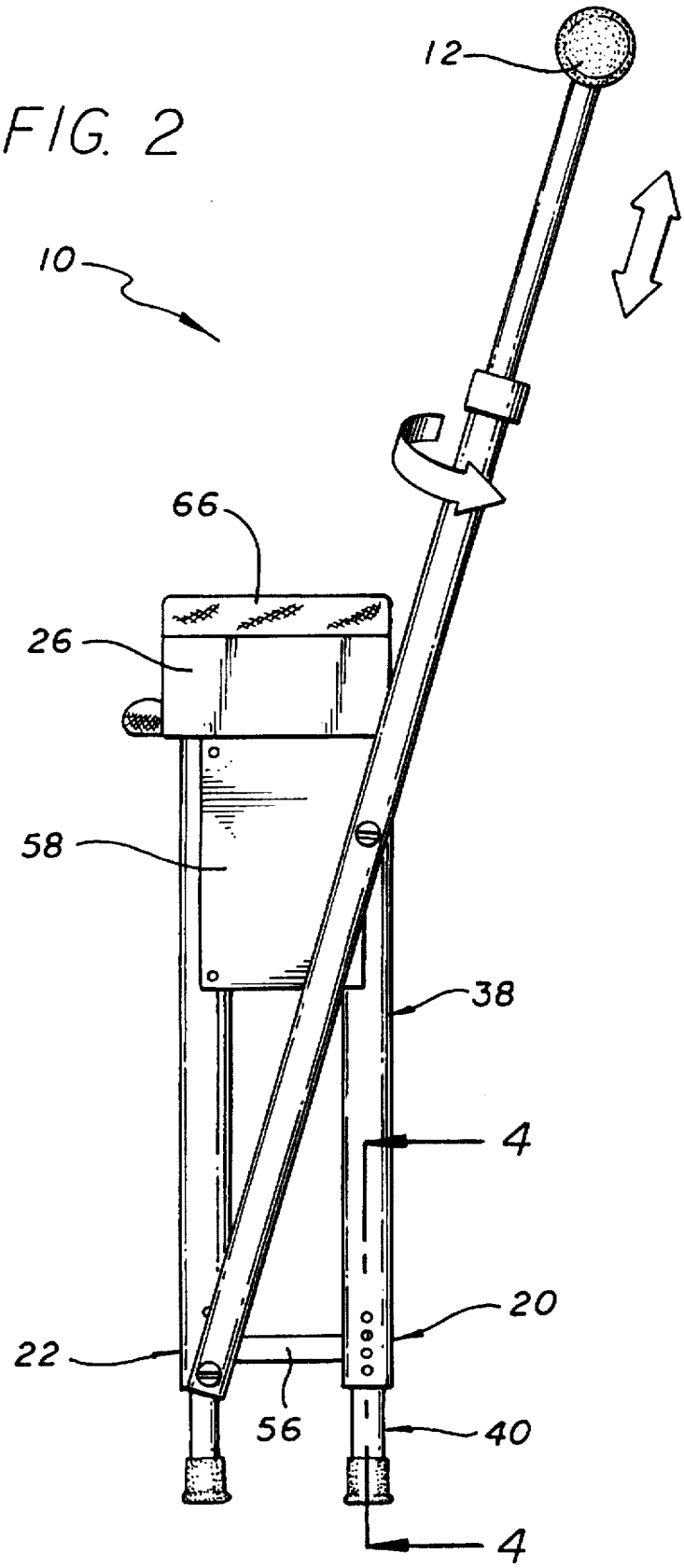
FIG. 2 is a side elevational view of the knee crutch of the present invention.
Figure 3:
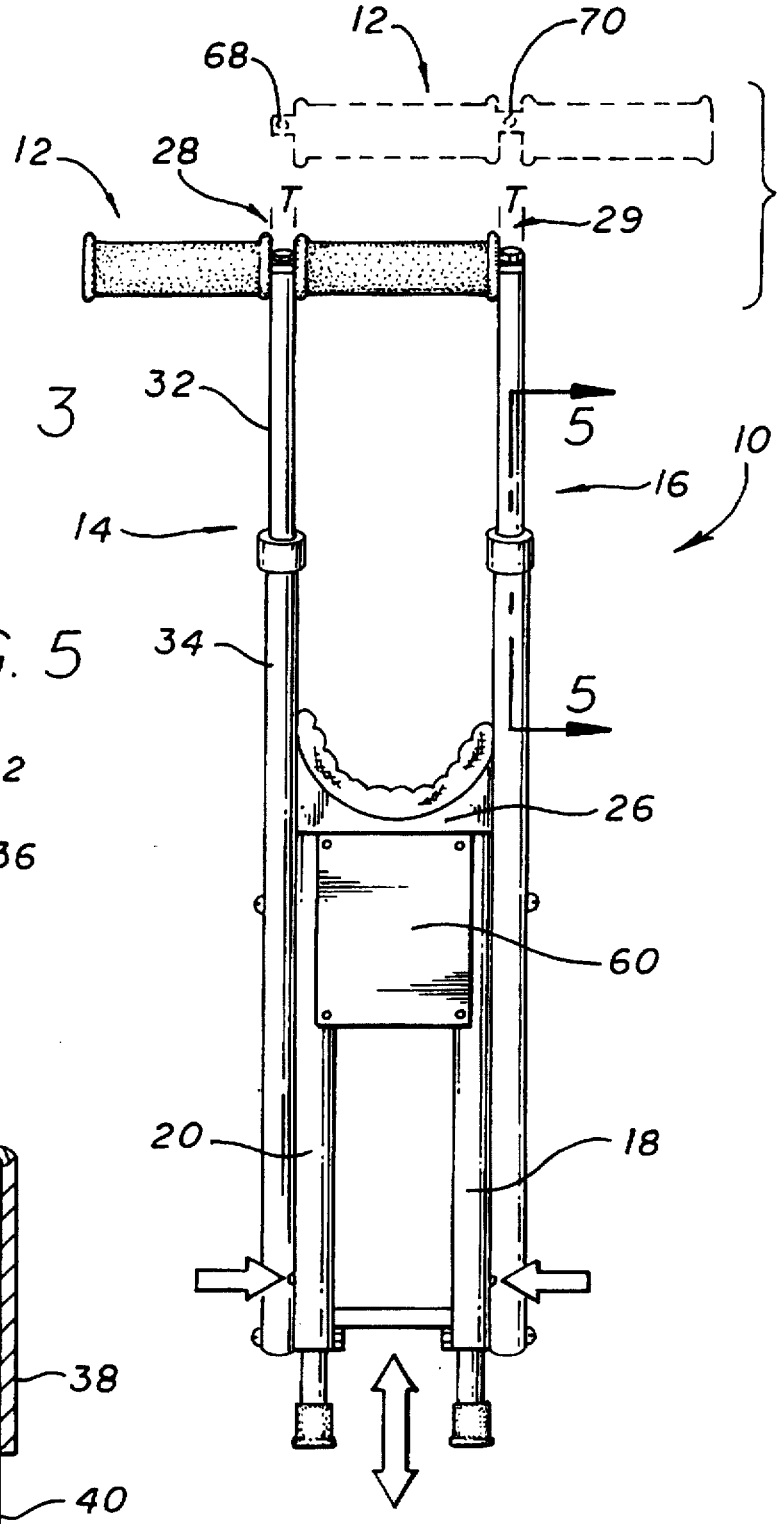
FIG. 3 is a front elevational view, showing the handle 12 positioned for use with a left leg injury and the same handle rotated (in relief into position for use with a right leg injury.

Referring to FIGS. 1, 2 and 3, cross members may be mounted to the knee crutch 10 to provide additional structural support. In a preferred embodiment, lower cross member 50 is mounted to and between leg 18 and leg 20; lower cross member 52 is mounted to and between leg 18 and leg 24; lower cross member 54 is mounted to and between leg 24 and leg 22; and lower cross member 56 is mounted to and between leg 22 and leg 20. Lower cross members 50, 52, 54, and 56 are mounted to legs 18, 20, 22, and 24 at locations distant from the knee support 26. Additional structural support can be obtained by adding upper support panels, such as upper support panel 58, which is mounted to knee support 26, leg 22 and leg 20; upper support panel 60 which is mounted to knee support 26, leg 20 and leg 18; upper support panel 62 (not shown) which is approximately parallel to upper support panel 58 and is mounted to knee support 26, leg 18 and leg 24; and upper support panel 64 (not shown) which is approximately parallel to upper support panel 60 and is mounted to knee support 26, leg 22 and leg 24. For added comfort, the knee support 26 may be fitted with a cushion or pad, such as support pad 66.

In operation, a new user of the present invention will adjust it to his or her height and injury. FIGS. 1–3 show the knee crutch 10 configured for a patient with a right leg injury. Referring to FIG. 3, a patient with a left leg injury would unscrew screws 28 and 29, lift and rotate handle 12 180 degrees until handle aperture 70 was positioned atop upright portion 16 and handle aperture 68 was positioned atop upright portion 14. Whereupon the user inserts screw 28 into handle aperture 68 and secures it into a threaded aperture (not shown) in upright portion 14. Similarly, screw 29 is inserted into handle aperture 70 and secured into a threaded aperture (not shown) in upright portion 16.

Once the handle has been adjusted for right or left leg injury (if necessary), the height of the knee support 26 is then adjusted until it comfortably supports the knee of the user. This is accomplished making any necessary change in the length of the legs, such as leg 20. The user will depress the spring loaded locking pin 42, and pull the foundation portion 40 outwardly or inwardly relative to the knee portion 38 until the knee support 26 is at the proper height from the ground. The user will then allow the spring loaded locking pin 42 to engage the nearest aperture, such as aperture 44, 46 or 48. The other legs will then be similarly adjusted to match in height.

The user will then adjust the height of the handle 12, by adjusting the length of the upright portions 14 and 16. The internal clamp 36 is rotated counter clockwise to release pressure against the upper upright section 32 and allow it to freely telescope relative to the lower upright section 34. The handle 12 may then be urged upwards or downwards by the user, until it rests across the abdomen at a comfortable height for walking and standing. Then the handle 12 is secured in place by tightening the internal clamp 36 for upright portion 14 and upright portion 16. The knee crutch 10 is now ready for use.

FIG. 1 shows a patient with a left leg injury using the present invention. The user bends his left leg rearwardly and rests his knee on the knee support 26. The patient's hands grasp the handle 12, which also can rest comfortably across the patient's abdomen. Patient's weight is supported by the knee support 26, through the upper leg—just as occurs naturally with a healthy leg (unlike crutches, which transfer the weight to the arms).

The knee crutch 10 can be used in a number of ways. It can serve as a stationary support when the user needs to stand while waiting or performing tasks. The combination of the four legs (18, 20, 22 and 24), which hold the unit steady, and the handle 12 resting against the patient's abdomen, which provides support for the patient and eliminates the need for griping the handle 12, liberates the hands for other tasks.

When the knee crutch 10 is used for walking, the patient will place the knee crutch 10 directly in front of the injured leg, grasp the handle 12 with his or her hands, and rest the knee on the support pad 66. The patient will then push off with the uninjured leg, and push forward on the handle 12, either with the hands or abdomen. At the same time, the uninjured leg is passed by the knee crutch 10 and planted on the ground forward of the knee crutch 10. The forward motion rocks the knee crutch 10 on to legs 18 and 22. Unlike monoped crutches, the knee crutch 10 always rests on at least two legs. The patient will then pull the handle 12 upwards and forwards, until the injured leg passes the uninjured leg, at which point the knee crutch 10 rests on legs 22 and 24. This process is then repeated as the uninjured leg is brought forward, past the injured leg, causing the knee crutch 10 to rock from legs 22 and 24 to legs 18 and 20. This use of four legs (18, 20, 22 and 24) simulates the sensation, muscle use, balance and motion of natural walking. By receiving the weight on the "heel" (legs 18 and 20) and transferring that weight to the "toe" (legs 22 and 24), the natural "heel-to-toe" weight shift is duplicated.

Having now described the invention in accordance with the requirements of the patent statues, those skilled in this art will understand how to make changes and modifications in the present invention to meet their specific requirements or conditions. For instance, instead of four legs (legs 18, 20, 22 and 24), a single large telescoping tube, with a square lower cross-section or a foot-shaped base, may be substituted. Such changes and modifications may be made without departing from the scope and spirit of the invention as set forth in the following claims.

What is claimed is:

1. A knee crutch, for supporting a selected knee of a patient with a lower leg injury or disability on the same side of the patient as the selected knee, comprising:

a knee support for supporting and receiving the selected knee;

at least one base portion having an upper end and a lower end, the base portion connected to the knee support adjacent to the upper end and engaging the floor at the lower end; and at least one upright portion, each upright portion having a first end and a second end, being connected to the knee support adjacent to the second end and connected to a handle portion at the first end said handle portion extending laterally beyond the knee support towards the other side of the patient;

in which the base portion, the upright portion and the handle portion are sized and oriented so the knee may rest in contact with in the knee support and the handle portion may rest in contact across substantially an entire forward facing portion of the patient's abdomen when the patient is in a standing position, whereby the knee support and handle may cooperate with the knee and abdomen respectively to thereby support the patient when the patient is standing, and whereby the handle may be urged forwardly by the patient away from the abdomen to thereby simulate a heel-to-toe motion when the patient is walking with the knee supported by the knee support.

2. A knee crutch of claim 1 wherein the knee support is sized to support the patient by the patient's knee resting against the knee support and a portion of the patient's weight being transmitted to the knee support via the upper leg of the patient.

3. A knee crutch of claim 1 wherein the knee support is concave in shape.

4. A knee crutch of claim 1 wherein the knee support includes a padded upper portion.

5. A knee crutch of claim 1 wherein the upright portion is adjustable in height.

6. A knee crutch of claim 5 wherein the upright portion comprises two sections in telescoping relationship adjustable in height by an internal clamp.

7. A knee crutch of claim 5 wherein the upright portion comprises two sections in telescoping relationship adjustable in height by an one or more locking pins.

8. A knee crutch of claim 1 wherein each base portion is adjustable in height.

9. A knee crutch of claim 8 wherein each base portion comprises two sections in telescoping relationship adjustable in height by an internal clamp.

10. A knee crutch of claim 8 wherein each base portion comprises two sections in telescoping relationship adjustable in height by an one or more locking pins.

11. A knee crutch of claim 1 wherein the handle extends laterally from the knee crutch on two sides, a right side and a left side.

12. A knee crutch of claim 11 wherein the handle extends further laterally from the right side than from the left side, for accommodating patients with left side injuries.

13. A knee crutch of claim 11 wherein the handle extends further laterally from the left side than from the right side, for accommodating patients with right side injuries.

14. A knee crutch of claim 11 wherein the lateral extension of the handle is reversible between right side and left side.

15. A knee crutch of claim 1 wherein the knee crutch is adapted for walking in a simulated heel-to-toe motion.

16. A knee crutch of claim 1 further comprising four base portions.

17. A knee crutch of claim 1 wherein the second end of the base portion has a square cross-section.

18. A knee crutch of claim 1 wherein the second end of the base portion has a cross-section substantially resembling a foot.

19. A knee crutch of claim 1 wherein the handle extends laterally from the knee crutch on the right side, for accommodating patients with left side injuries.

20. A knee crutch of claim 1 wherein the handle extends laterally from the knee crutch on the left side, for accommodating patients with right side injuries.

21. A knee crutch, for supporting the knee of a patient with a lower leg injury or disability, comprising:

a knee support for supporting and receiving the patient's knee;

at least three base portions, each base portion comprising two sections in telescoping relationship and adjustable in height, and having an upper end and a lower end, the base portions being connected to the knee support adjacent to the upper end and engaging the floor at the lower end;

at least one upright portion, comprising two sections in telescoping relationship and adjustable in height, each upright portion having a first end and a second end, the upright portion being connected to the knee support adjacent to the second end and connected to a handle portion at the first end;

at least one handle, connected to the first end of the upright portion and extending laterally from the knee crutch asymmetrically and being reconfigurable for accommodating patients with either left side or right side injuries;

wherein the base portion, upright portion and handle portion are sized and oriented so the knee rests in the knee portion and the handle portion rests longitudinally substantially across the abdomen when the patient is in a standing position, allowing the patient to both stand and walk with a simulated heel-to-toe motion with the knee supported.

22. A method for supporting a knee of a patient with a lower leg injury or disability to allow the patient to walk and stand, comprising the steps of:

placing a knee receptacle atop a base portion, and adjusting the height to the level of the patient's knee;

placing a handle atop an upright portion mounted to the knee receptacle, and adjusting the height of the handle to the level of the patient's abdomen;

placing the patient's knee atop and against the knee support, and a forward facing portion of the patient's abdomen against the handle;

placing the handle across substantially an entire forward facing portion of the patient's abdomen;

lifting and forwardly pushing the handle away from the abdomen and moving the knee, knee receptacle, base portion and upright portion, to walk with a simulated heel-to-toe motion; and resting the base portion on the ground and urging the patient's abdomen against the handle to stand in a stationary position.

* * * * *